US005564886A

United States Patent [19]

Emerson et al.

[11] Patent Number: 5,564,886

[45] Date of Patent: Oct. 15, 1996

[54] DISPENSING ATTACHMENT FOR LOADERS

[76] Inventors: Earl W. Emerson, 5890 - 175 R Ave. SE, Walcott, N. Dak. 58077; Robert D. Skoog, 17450 - 60th St. SE, Walcott, N. Dak. 58077

[21] Appl. No.: 323,832

[22] Filed: Oct. 17, 1994

[51] Int. Cl.[6] ..... B66C 23/00

[52] U.S. Cl. ..... 414/725; 37/903; 414/912

[58] Field of Search ..... 414/526, 725, 414/912, 37, 141; 222/608, 412, 413; 37/903; 141/10

[56] References Cited

U.S. PATENT DOCUMENTS

| | | | |
|---|---|---|---|
| 3,240,401 | 3/1966 | Kirschmann | 222/412 |
| 3,552,346 | 1/1971 | Garden | 298/7 |
| 4,055,255 | 10/1977 | Vasquez | 414/725 |
| 4,065,011 | 12/1977 | Teti | 414/725 |
| 4,187,049 | 2/1980 | Jones | 414/725 |
| 4,858,346 | 8/1989 | Schulte | 37/903 |
| 5,004,022 | 4/1991 | Carlsson | 37/903 |
| 5,060,732 | 10/1991 | Baskett | 37/903 |
| 5,353,851 | 10/1994 | Cline | 37/903 |

*Primary Examiner*—Karen B. Merritt
*Assistant Examiner*—Gregory A. Morse

[57] ABSTRACT

A dispensing attachment for loaders includes a dispenser preferably made of metal and having a wall member for covering the loader and an arcuate end wall integrally connected to the wall member and having dispensing spouts. The dispenser is pivotally attached to a support which is detachably attached to the side walls of the loader. A hydraulic ram 40 is used to pivot the dispenser relative to the loader in a clam-like fashion such that the dispenser can be moved into engagement with the loader to essentially form a hopper or can be moved out of engagement with the loader so that the loader can be used to scoop up flowable material. An auger is journaled to the dispenser and driven by a hydraulic motor to feed the dispensing spouts with the flowable material such as sand. The dispensing attachment allows the user to use the load to scoop up the flowable material, engage the dispenser to the loader, and dispense the flowable material through the dispensing spouts.

9 Claims, 4 Drawing Sheets

DISPENSING ATTACHMENT FOR LOADERS

BACKGROUND OF THE INVENTION

This invention relates to a dispensing attachment for loaders, which dispenses flowable material such as sand into bags and which is attachable to loaders or mechanical shovels which can be used to scoop up flowable material which is then dispensed through the dispensing attachment into bags.

The prior art discloses different types of bag filling apparatuses which are used to conveniently put flowable material such as sand into bags which are primarily used to cordon off areas so as to protect property from floods and to erect barricades for protection against social unrest.

One known prior art is a CONVEYOR AND CHUTE, COMBINED WITH SWINGABLY MOUNTED MEASURE HOPPER, U.S. PAT. NO. 2,523,562, invented by John E. Eakin and Nelson S. Wallace, which comprises a conveyor, a chute disposed beneath the conveyor, a hopper mounted at the discharge end of the chute and having an outlet for dispensing flowable material which must be delivered to the conveyor by other means. The conveyor and chute structure is free-standing and not easily movable.

Another known prior art is a SAND-BAGGING ATTACHMENT FOR DUMP TRUCKS, U.S. PAT. NO. 3,552,346, invented by Kenneth S. Garden, which comprises a hopper attached to the back end of a dump truck and having dispensing chutes with gates therein and an auger means for moving sand through the hopper. Again like the other prior art, the sand must be retrieved and delivered by an outside means to the dump truck before the sand-bagging attachment can be implemented.

Another known prior art is a SAND BAG FILLING APPARATUS, U.S. PAT. NO. 4,044,921, invented by Warren R. Caverly, which comprises a hopper having rotatable longitudinal members, a conveyor which receives sand from the hopper and which transports the sand to a discharge end.

Another known prior art is a MECHANIZED BAG FILLING APPARATUS, U.S. Pat. No. 4,184,522, invented by Jerry A. Waite, which comprises a pivotable trailer-mounted bag filling assembly comprising a receptacle with an auger, a conveyor, and a chute having bagging heads and being self-contained with its own power plant.

Another known prior art is a BAG FILLING APPARATUS, U.S. PAT. NO. 4,585,042, invented by Leo J. Cavanagh, which comprises a hopper having bag filling chutes and a structure to selectively control the openings of the chutes.

Another known prior art is a SANDBAG FILLING DEVICE, U.S. PAT. NO. 5,215,127, invented by Guy E. Bergeron, which comprises a trailer having a vertical post with a distribution head at the top of the post, which is attached to filling spouts and further comprises a chute disposed at the top of the head, and a conveyor for supplying sand to the chute.

None of the prior art disclosed above has means which not only retrieves the flowable material but also dispenses the material into bags, a problem solved by the present invention which is not suggested nor anticipated by any of the prior art.

SUMMARY OF THE INVENTION

The present invention relates to a dispenser attachment for loaders to dispense flowable material such as sand into bags, the loader being mechanical shovels or loading buckets which are mounted to vehicles and used to scoop up and carry the flowable materials. The dispensing attachment comprises a dispenser means having a plurality of dispensing spouts for dispensing flowable material and having an auger to move the flowable material to the dispensing spouts, a motor means to actuate the auger, a means to mount the dispenser means to the loader, and a hydraulic means to move the dispenser means to either substantially close upon or open from about the loader which is used to scoop up the flowable material which, after the dispenser means is closed upon the loader, is dispensed into bags through the dispensing spouts.

One objective of the present invention is to provide a dispensing attachment for loaders which allows the user to retrieve and dispense the flowable material in a continuous uninterrupted process unlike any of the prior art.

Another objective of the present invention is to provide a dispensing attachment for loaders which greatly facilitates the retrieving of the flowable material and the dispensing of it into bags unlike any of the prior art.

Further, another objective of the present invention is to provide a dispensing attachment for loaders which is substantially less labor intensive and time consuming to fill bags with flowable material than any of the prior art.

Yet, another objective of the present invention is to provide a dispensing attachment for loaders which can be quickly and conveniently attached to and detached from the loaders which are mounted to vehicles.

Further objectives and advantages of the present invention will become apparent as the description proceeds and when taken in conjunction with the accompanying drawings wherein:

DETAILED DESCRIPTION OF THE INVENTION

Figure 1:
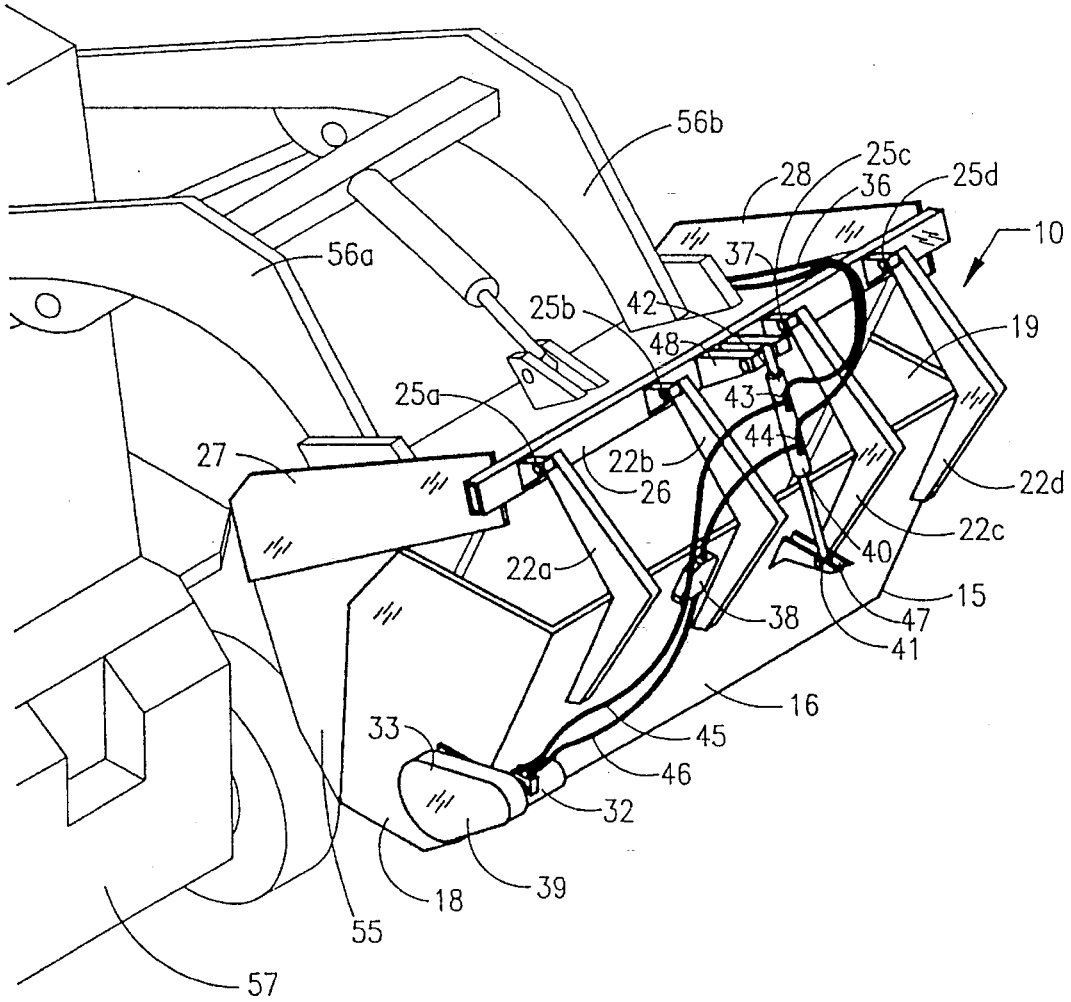
FIG. 1 is a perspective view of the dispensing attachment mounted in a dispensing position about a loader which is mounted to a vehicle.
Figure 2:
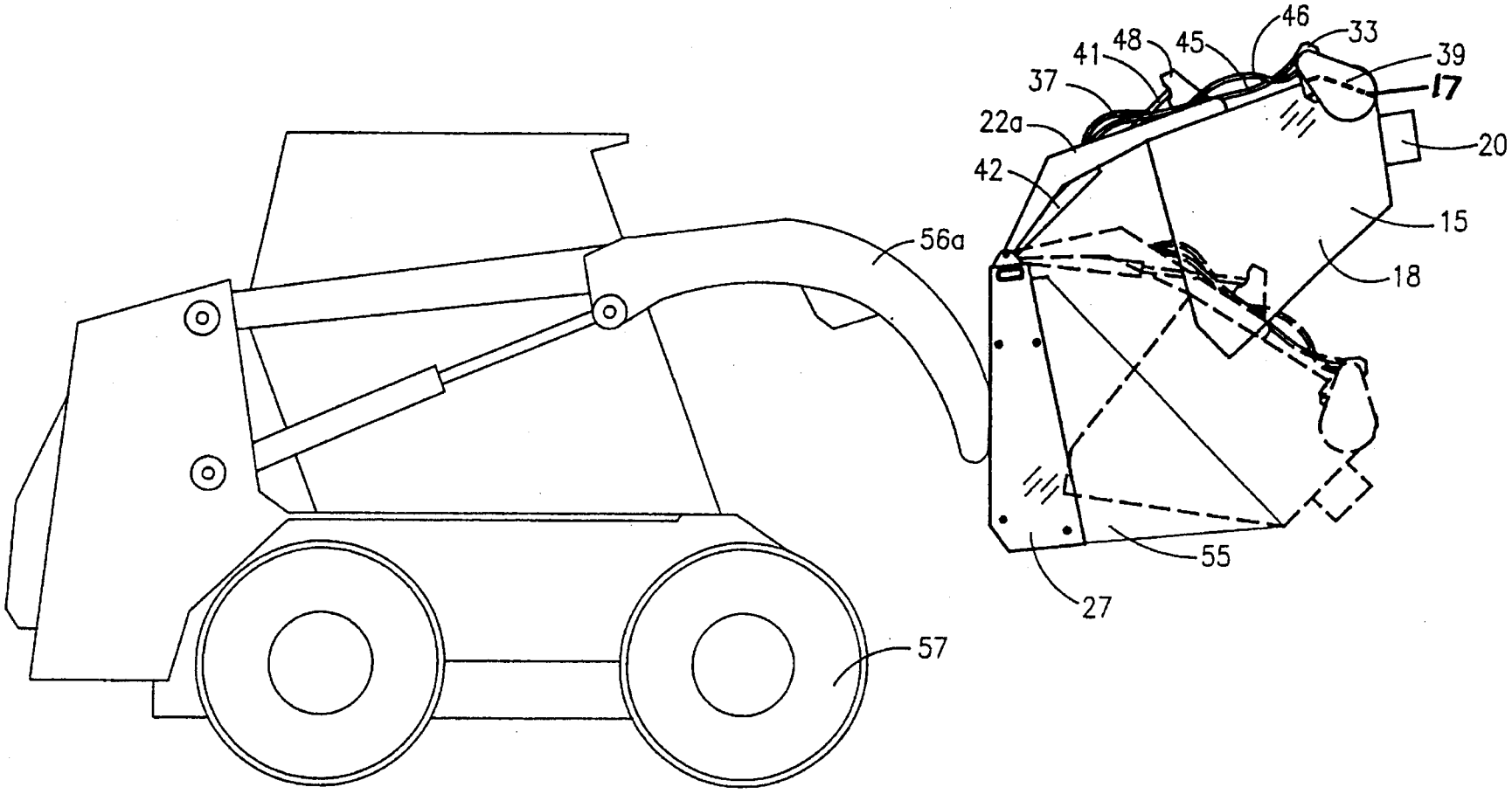
FIG. 2 is a side view of the dispensing attachment mounted in a nondispensing position to the loader which is mounted to a vehicle.
Figure 3:
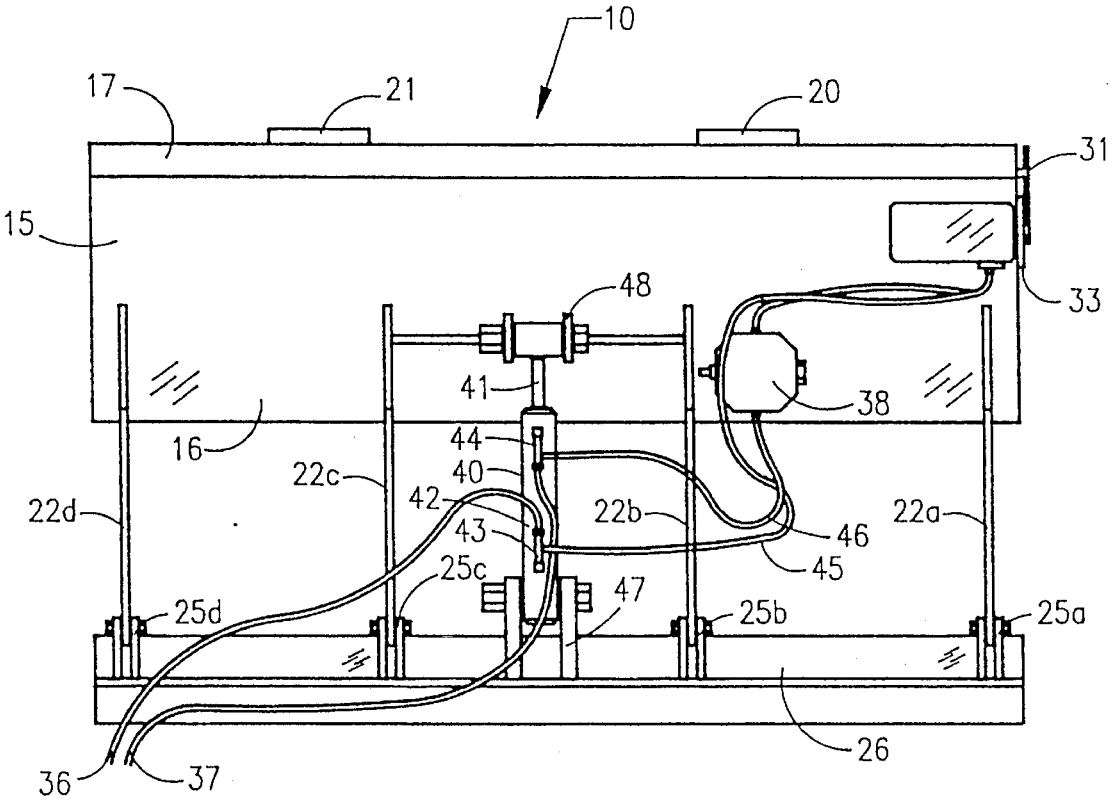
FIG. 3 is top plan view of the dispensing attachment mounted to the loader.
Figure 4:
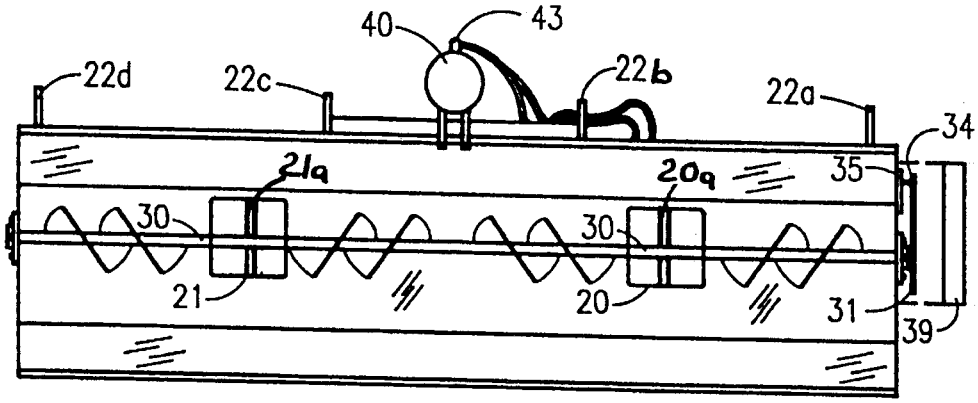
FIG. 4 is a rear end perspective view of the dispensing attachment showing, in particular, the auger means.
Figure 5:
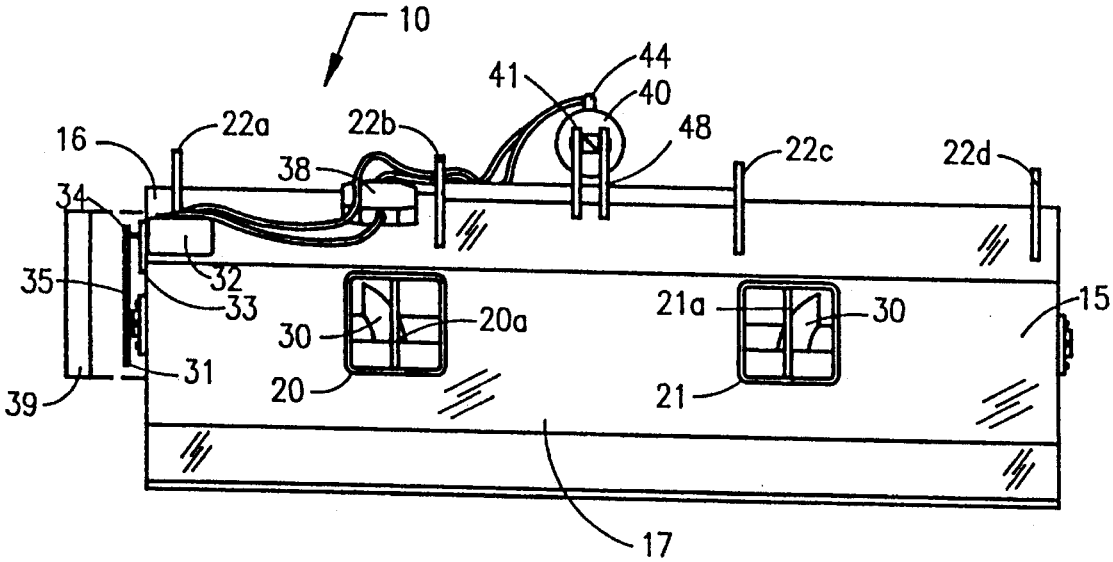
FIG. 5 is a front end elevation view of the dispensing attachment showing, in particular, the dispensing spouts.

Referring to the drawings in FIGS. 1–5, in particular, the dispensing attachment 10 for loaders comprises a dispenser means 15 having a wall member 16 to substantially removably close over the top of the loader 55 which is mounted to arm-like supports 56*a–b* which is pivotally attached to a vehicle 57 such as a tractor or grater or the like, the wall member 16 having an arcuate or jaw-like portion 17 extending therefrom and adapted to support flowable material and further adapted to substantially abut against the edge of the bottom wall or floor of the loader 55 to close upon the loader 55 which in combination with the dispenser means 15 is capable of storing flowable material between the dispenser means 15 and the loader 55, the dispenser means 15 further having two end walls 18 & 19 fixedly attached or welded to the wall member 16 along side edges of the wall member 16 and adapted to close over portions of the exteriors of the two end walls 18 & 19 of the loader 55. As shown in FIGS. 1, 2 & 5, two dispensing spouts 20 & 21 extend through and from the jaw-like portion 17 of the wall member 16 and are spaced along the length of the wall member 16 and have passages for dispensing the flowable material such as sand stored between the dispenser means 15 and the loader 55. Protective crosspieces 20*a* & 21*a* are fixedly mounted in the passages of the dispensing spouts 20 & 21 to substantially guard against a person from putting his/her hand through the dispensing spout into the auger 30 and getting his/her hand hurt in the process.

As illustrated in FIGS. 1–4, four mounting arms 22*a–d* are spaced along the length of the dispenser means 15 and are fixedly attached or welded to the exterior of the wall member 16 and are extended parallel to one another and are extended outward in the opposite direction of the jaw-like portion 17 of the wall member 16. The four mounting arms 22*a–d* have ends which are pivotally mounted to a dispenser means 15 mounting means, which comprises an elongate support member 26 mountable upon and along the top edge of the back wall of the loader 55, a pair of plate-like lug means 27 & 28 fixedly attached or welded to the ends of the elongate support member 26 and extending generally perpendicular to the support member 26 and having a plurality of holes therethrough for detachably attaching with bolts to the exteriors of the end walls 18 & 19 of the loader 55 near the back wall of the loader 55, the mounting means further comprising four clevis-like pivots means 25*a–d* fixedly attached or welded to and spaced along the top of the elongate support member 26 to receive the ends of the mounting arms 22*a–d*, which have holes therethrough for receiving fastener members such as bolts or the like which hold the dispenser means 15 to the support member 26.

As shown in FIGS. 1–4, a pivot means 25*a–d* for pivoting the dispenser means 15 closedly upon the loader 55 comprises a hydraulic ram 40 having a cylinder 42 detachably mounted at an end thereof with bolts to a first mounting bracket 47 which is fixedly attached or welded to the top of the elongate support member 26 and a piston 41 slidably mounted in the cylinder 42 and having an end detachably attached with bolts or the like to a second mounting bracket 48 fixedly attached or welded on the exterior of the wall member 16 near the edge of the wall member 16 opposite the jaw-like portion 17. The cylinder 42 has an inlet port for receiving fluid from a fluid supply means and has an outlet port for discharging or returning fluid delivered to the cylinder 42. A lead-in hose 36 for delivering fluid from the fluid supply means to the cylinder 42 is connected to an inlet hose adapter 43 which is threaded into the inlet port in the cylinder 42. A fluid discharging hose 45 is connected to an outlet hose adapter 44 threaded in the outlet port in the cylinder 42 and is connected to a pressure sensitive valve 38 which is securely mounted upon the outer surface of the wall member 16. The pressure sensitive valve 38 controls the flow of the fluid to a hydraulic motor 32 which is connected to the valve 38 by a first connecting hose 46. The hydraulic motor 32 is securely mounted with bolts or the like to a motor mount 33 which is securely fastened with bolts or the like to the exterior of one of the end walls 18 & 19 of the dispenser means 15. The hydraulic motor 32 has a rotatable shaft which is connected to a first sprocket 34 which is connected by an endless chain 35 to a second sprocket 31 having a diameter substantially larger than the first sprocket 34. The second sprocket 31 is attached to an auger 30 which is journaled to the interiors of the side walls 18 & 19 of the dispenser means 15, both the first and second sprockets being covered by a protective shroud 39 to substantially prevent injuries. The auger 30 is disposed substantially parallel to the wall member 16 and is rotatably disposed in a trough formed between the end walls 18 & 19 and the arcuate end portion of the wall member 16, and further has right and left flighting to feed the flowable matter to the dispensing spouts 20 & 21. When activated, the hydraulic motor 32 rotates the first sprocket 34 which drives the second sprocket 31 at a speed substantially less than the speed of the first sprocket 34. The rotating second sprocket 31 rotates the auger 30 which feeds the flowable material contained in between the loader 55 and the dispenser means 15 to the dispensing spouts 20 & 21 and is dispensed therefrom by gravitational means. The hydraulic motor 32 can be energized only after the dispenser means 15 is closed upon the loader 55. Once the dispenser means 15 is closed, fluid being delivered to the cylinder 42 from the fluid supply means is discharged out of the outlet port of the cylinder 42 and delivered through the pressure sensitive valve 38 and to the hydraulic motor 32 which is energized and rotates the first sprocket 34 which actuates the second sprocket 31. The hydraulic motor 32 is automatically shut off when the dispenser means 15 is pivoted away from about the loader 55. Fluid must be delivered to the cylinder 42 from the fluid supply source to urge the piston 41 into the cylinder 42 which pivots the dispenser means 15 away from the loader 55. When this happens, little or no fluid is discharged from the cylinder 42 to the valve 38 which is closed and prevents fluid from energizing the hydraulic motor 32. The valve 38 controls the flow of fluid to the hydraulic motor 32. If the pressure or force of the fluid being delivered to the valve 38 is less than the pressure needed to open the valve 38 to allow the fluid to pass to the hydraulic motor 32, the valve 38 remains closed and the hydraulic motor 32 is not energized. This is a safety mechanism for users, so that the users do not get caught in an rotating auger 30 and injure themselves.

The dispenser attachment can easily mounted upon the loader 55. The lug means 27 & 28 should be bolted to the end walls 18 & 19 of the loader 55 with the elongate support member 26 mounted upon the top edge of the back wall of the loader 55 with the dispenser means 15 pivotally attached to the elongate support member 26 and extending above and over the top of the loader 55. The hoses 36 & 37 to deliver fluid to and from the pivoting means and the feeder means must be connected to a fluid or power supply means for dispensing the flowable material. To fill bags with the flowable material using the dispensing attachment 10, the user must first load the loader 55 with the flowable material. He/she can do this by pivoting the dispenser means 15 away from the top of the loader 55 by actuating the hydraulic ram 40 to urge the dispenser means 15 upward and away from the loader 55 and lowering the loader 55 to the ground and driving the loader 55 into a pile of flowable material to scoop up the flowable material onto the loader 55. The dispenser means 15 should be lowered over the top of the loader 55 to contain the flowable material therein. Again, the user can do this by manipulating the flow of fluid to the hydraulic ram 40 which urges the dispenser means 15 about the top of the loader 55 to substantially close the flowable material in between the loader 55 and the dispenser means 15. Once the dispenser means 15 is closed upon the top of the loader 55, the loader 55 should be raised and should be tilted such that the dispensing spouts 20 & 21 are facing downward toward the ground, and fluid being delivered to the hydraulic ram 40 will be discharged through the valve 38 and will energize the hydraulic motor 32 which will drive the sprockets which will rotate the auger means 30 which will feed the flowable material contained in between the dispenser means 15 and the loader 55 to the dispensing spouts 20 & 21 where the flowable material such as sand can be dispensed by gravitational means into bags which can be placed about the end of the spouts. This process can be repeated as often as desired by the user by reloading the loader 55 with the flowable material.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A dispensing attachment for a loader comprising:

a dispenser means having at least one dispensing spout for dispensing flowable material;

a means for attaching said dispenser means to said loader, said dispenser means being pivotally attached to said attaching means;

a means for pivoting said dispenser means relative to said loader, to either close said dispenser means upon said loader which in combination with said dispenser means is adapted to hold said flowable material for dispensing through said at least one dispensing spout or to pivotally remove said dispenser means from about said loader; and a means to feed said flowable material to said at least one dispensing spout.

2. A dispensing attachment for a loader as described in claim 1, wherein said dispenser means further comprises a wall member having a jaw-like portion extending therefrom and along the length thereof, two end walls fixedly attached to said wall member, and a plurality of mounting arms fixedly attached to said wall member and being pivotally attached to said attaching means.

3. A dispensing attachment for a loader as described in claim 2, wherein said wall member has a length longer than that of said loader such that said side walls of said wall member removably close about end walls of said loader.

4. A dispensing attachment for a loader as described in claim 3, wherein said jaw-like portion in cooperation with said end walls of said wall member essentially forms a trough for receiving said flowable material, said feeder means including an auger rotatably mounted in said trough for moving said flowable material to said at least one dispensing spout.

5. A dispensing attachment for a loader as described in claim 2, wherein said at least one dispensing spout extends from and through said jaw-like portion of said wall member and further has a passage therethrough for dispensing said flowable material.

6. A dispensing attachment for a loader as described in claim 2, wherein said attaching means further comprises an elongate support member and a pair of lug members each of which is fixedly attached to respective ends of said support member and is detachably attached to side walls of said loader for mounting and supporting said dispensing attachment to said loader.

7. A dispensing attachment for loaders as described in claim 6, wherein said support member further comprises a plurality of pivot members fixedly attached thereto, said mounting arms being pivotally and detachably attached to said pivot members.

8. A dispensing attachment for loaders as described in claim 6, wherein said pivoting means further comprises a hydraulic ram securely mounted to a pair of mounting brackets, one of which is fixedly attached to said elongate support member and the other of which is fixedly attached to said wall member, for pivoting said dispenser means relative to said loader.

9. A dispensing attachment for loaders as described in claim 8, wherein said hydraulic ram is supplied fluid from a fluid supply means either to pivot said dispenser means closedly about said loader which in combination with said dispenser means is capable of storing said flowable material or to pivot said dispenser means away from about said loader so that said flowable material can be loaded onto said loader.

* * * * *